US011458381B2

(12) United States Patent
Bush et al.

(10) Patent No.: US 11,458,381 B2
(45) Date of Patent: Oct. 4, 2022

(54) ATHLETIC TRAINING DEVICE AND SYSTEM

(71) Applicant: TP Sports Technologies, LLC, Granger, IN (US)

(72) Inventors: Craig D. Bush, Granger, IN (US); Kyle A. Buzzard, Lombard, IL (US); Gabriel P. Coyne, Saint Charles, IL (US)

(73) Assignee: TP Sports Technologies, LLC, Granger, IN (US)

( * ) Notice: Subject to any disclaimer, the term of this patent is extended or adjusted under 35 U.S.C. 154(b) by 0 days.

(21) Appl. No.: 16/508,239

(22) Filed: Jul. 10, 2019

(65) Prior Publication Data

US 2021/0008433 A1 Jan. 14, 2021

(51) Int. Cl.
*A63B 69/00* (2006.01)
*A63B 71/06* (2006.01)

(52) U.S. Cl.
CPC ..... *A63B 71/0622* (2013.01); *A63B 69/0002* (2013.01); *A63B 69/002* (2013.01); *A63B 69/0024* (2013.01); *A63B 69/0071* (2013.01); *A63B 71/0686* (2013.01); *A63B 2069/0006* (2013.01); *A63B 2071/0625* (2013.01); *A63B 2071/0694* (2013.01); *A63B 2220/40* (2013.01); *A63B 2225/54* (2013.01); *A63B 2225/74* (2020.08)

(58) Field of Classification Search
CPC ..... A63B 71/0622; A63B 69/0002; A63B 69/002; A63B 69/0024; A63B 69/0071; A63B 71/0686; A63B 2069/0006; A63B 2225/54; A63B 2071/0625; A63B 2071/0694; A63B 2207/02; A63B 2220/40
USPC ..... 473/422, 446, 447, 451, 431
See application file for complete search history.

(56) References Cited

U.S. PATENT DOCUMENTS 3,080,859 A * 3/1963 Benkoe ..... A63B 69/409 473/418
3,545,752 A * 12/1970 Hill ..... A63B 69/407 124/16
3,627,319 A * 12/1971 Van Skyhawk ..... A63B 69/407 124/16
4,657,252 A * 4/1987 Spiegel ..... A63B 69/0075 473/420
4,778,177 A * 10/1988 Taksony ..... A63B 69/407 124/34
4,834,375 A * 5/1989 Elstein ..... A63B 24/00 473/417
4,865,318 A * 9/1989 Lehmann ..... A63B 69/407 124/16
4,915,384 A * 4/1990 Bear ..... A63B 24/0021 473/451

(Continued)

FOREIGN PATENT DOCUMENTS

ES 1216849 U 8/2018

*Primary Examiner* — Mitra Aryanpour
(74) *Attorney, Agent, or Firm* — Clements Bernard Baratta; Christopher L. Bernard

(57) ABSTRACT

Disclosed embodiments include athletic training devices and systems. In a non-limiting embodiment, an athletic training device includes: a chassis, a portion of the chassis being configured to receive a ball thereon; a sensor configured to sense presence of a ball on the portion of the chassis; and a display device responsive to the sensor.

45 Claims, 20 Drawing Sheets

(56) References Cited

U.S. PATENT DOCUMENTS 5,011,144 A * 4/1991 Marello ..... A63B 69/0075 473/418
5,125,653 A * 6/1992 Kovacs ..... A63B 69/406 124/78
5,221,081 A * 6/1993 Rooks ..... A63B 69/407 124/16
5,529,307 A * 6/1996 Chang ..... A63B 57/0006 473/136
5,590,876 A * 1/1997 Sejnowski ..... A63B 69/407 473/417
5,597,160 A * 1/1997 Mims ..... A63B 69/407 124/16
5,704,612 A * 1/1998 Kelly ..... A63B 63/08 473/417
5,860,648 A * 1/1999 Petermeier ..... A63B 67/02 473/159
5,897,445 A * 4/1999 Sanders ..... A63B 24/0003 473/421
5,911,214 A * 6/1999 Andrews ..... A63B 69/408 124/16
6,424,598 B1 7/2002 Shultz
6,443,859 B1 * 9/2002 Markin ..... A63B 69/406 473/451
7,861,699 B2 * 1/2011 Gowan ..... A63B 69/407 124/16
7,951,045 B1 5/2011 Brader
7,958,880 B1 * 6/2011 Mashburn ..... A63B 69/0002 124/65
7,959,501 B2 6/2011 Harmon et al.
8,042,531 B2 * 10/2011 Mashburn ..... A63B 69/0002 124/65
8,617,008 B2 * 12/2013 Marty ..... A63B 69/0071 473/447
8,992,347 B2 * 3/2015 Moran ..... A63B 69/36 473/407
9,022,016 B1 * 5/2015 Hafer ..... F41B 4/00 473/451
9,067,119 B1 * 6/2015 Vaught ..... F41B 3/04 124/16
9,114,297 B1 * 8/2015 Saumell ..... A63B 69/0002 473/418
10,112,097 B2 * 10/2018 LoDuca ..... A63B 69/0075 473/451
10,421,001 B2 * 9/2019 Moore ..... A63B 47/02 473/451
10,497,278 B2 * 12/2019 Loduca ..... G09B 19/0038 473/417
10,549,166 B1 * 2/2020 Mueller ..... A63B 69/0075 473/417
10,556,166 B2 * 2/2020 Kim ..... A63B 47/002 473/451
10,631,522 B2 * 4/2020 So ..... A01K 15/025 124/16
2006/0199671 A1 9/2006 Town
2012/0081531 A1 4/2012 DeAngelis et al.
2014/0330410 A1 11/2014 Lochmann
2015/0174441 A1 6/2015 Junaid et al.
2016/0001136 A1 1/2016 King et al.
2016/0038820 A1 2/2016 Junaid et al.
2016/0243426 A1 * 8/2016 Griffin ..... A63B 69/0075
2016/0271448 A1 9/2016 Edelhaeusser et al.
2017/0296894 A1 10/2017 Min
2018/0056160 A1 * 3/2018 LoDuca ..... A63B 69/0002 473/451

* cited by examiner

110

112

114

116

118

120

122

124

126

128

130

140

142

144

146

ATHLETIC TRAINING DEVICE AND SYSTEM

TECHNICAL FIELD

The present disclosure relates to athletic training devices and systems.

BACKGROUND

The statements in this section merely provide background information related to the present disclosure and may not constitute prior art.

Personalized athletic training can be expensive, difficult to access, and inconsistent. For example, many training methods may allow an athlete to cheat with respect to the athlete's form and with respect to repetitions. As another example, currently-known at-home drills do not provide means for tracking progress or means for competing (such as via social media). Moreover, for elite-level athletes, training opportunities may be limited by geography and by financial costs of accessing an elite-level coach.

Furthermore, currently-known athletic training devices and systems do not provide holistic, connected training. For example, one currently-known athletic training system (Spalding's "ShotTracker") entails mounting sensors on basketball players, installing sensors in a basketball facility, and embedding sensors in basketballs (such as Wilson's "Connected Ball") in order to merely generate statistics and analytic information regarding basketball shots. As such, ShotTracker does not address dribbling or strength issues.

As another example, another currently-known athletic training system ("DribbleUp") entails a specialized basketball, a smart-phone app, and a specialized stand. While DribbleUp addresses basketball dribbling, DribbleUp does not address basketball shooting or strength.

SUMMARY

Disclosed embodiments include athletic training devices and systems.

In a non-limiting embodiment, an athletic training device includes: a chassis, a portion of the chassis being configured to receive a ball thereon; a sensor configured to sense presence of a ball on the portion of the chassis; and a display device responsive to the sensor.

In another non-limiting embodiment, an athletic training device includes: a chassis including a cone, a portion of the chassis being configured to receive a ball thereon; a sensor including a proximity sensor, the sensor being configured to sense presence of a ball on the portion of the chassis; and a display device including a plurality of light-emitting diodes, the display device being responsive to the sensor.

In another non-limiting embodiment, an athletic training system includes: an athletic training device including: a chassis, a portion of the chassis being configured to receive a ball thereon; a sensor configured to sense presence of a ball on the portion of the chassis; and a display device responsive to the sensor; and at least one user interface device.

The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the text (e.g., claims and/or detailed description) and/or drawings of the present disclosure.

BRIEF DESCRIPTION OF THE FIGURES

Illustrative embodiments are illustrated in referenced figures of the drawings. It is intended that the embodiments and figures disclosed herein are to be considered illustrative rather than restrictive.

DETAILED DESCRIPTION

Figure 1A:
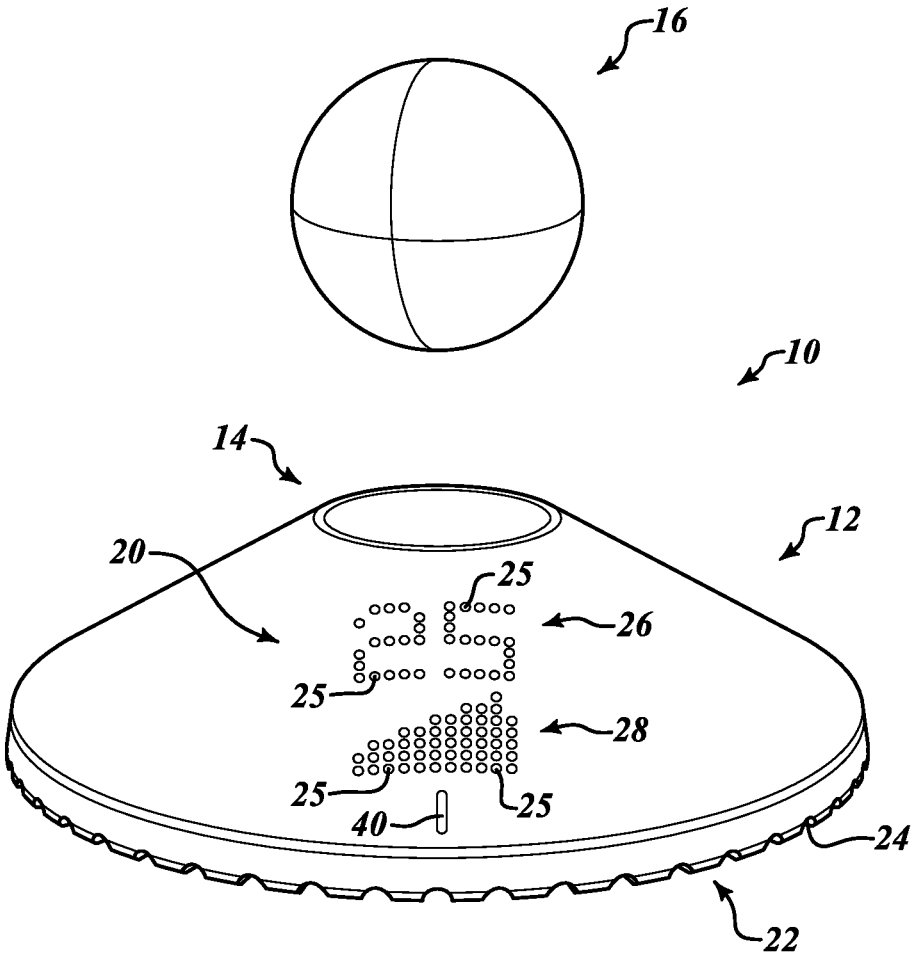
FIG. 1A is a perspective view of an illustrative athletic training device.

In the following detailed description, reference is made to the accompanying drawings, which form a part hereof. In the drawings, the use of the same symbols in different drawings typically indicates similar or identical items unless context dictates otherwise. The illustrative embodiments described in the detailed description, drawings, and claims are not meant to be limiting. Other embodiments may be utilized, and other changes may be made, without departing from the spirit or scope of the subject matter presented here.

Overview

Figure 1B:
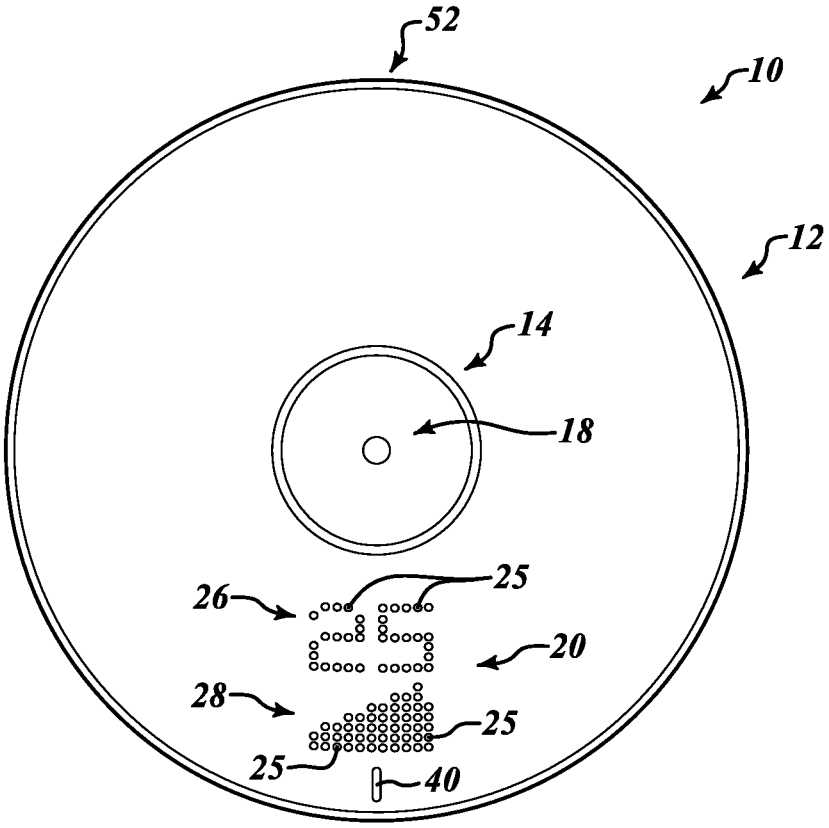
FIG. 1B is a top plan view of the athletic training device of FIG. 1A.
Figure 1C:
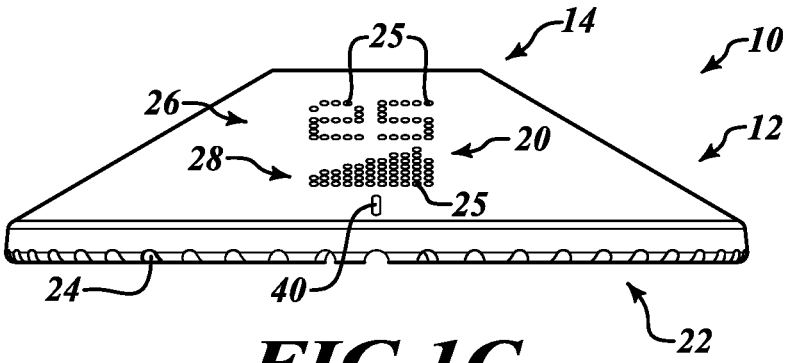
FIG. 1C is front plan view of the athletic training device of FIG. 1A.

Given by way of non-limiting overview and referring to FIGS. 1A-1C, in a non-limiting embodiment, an illustrative athletic training device 10 includes a chassis 12. A portion 14 of the chassis 12 is configured to receive a ball 16 (FIG. 1A) thereon. A sensor 18 (FIG. 1B) is configured to sense presence of the ball 16 on the portion 14 of the chassis 12. A display device 20 is responsive to the sensor 18.

Still by way of overview, it will be appreciated that, in various embodiments, the athletic training device 10 can time, count, and/or track an athlete's individual workouts as desired. It will be further appreciated that, in some embodiments, the athletic training device 10 can log the workouts into an application (discussed below).

Now that an overview has been provided, details of various embodiments will be explained by examples provided by way of illustration only and not of limitation.

Illustrative Examples of Athletic Training Devices and Systems

Still referring to FIG. 1, in various non-limiting embodiments the chassis 12 may include a cone. In such embodiments, a cone-shaped implementation of the chassis 12 can help provide the chassis 12 with a low center of gravity and a large surface area on a bottom surface 22 of the chassis 12. It will be appreciated that, in such embodiments, a low center of gravity and a large surface area on the bottom surface 22 can help increase stability of the chassis 12, thereby lowering the likelihood that the chassis 12 may tip over during athletic drills. However, it will also be appreciated that the chassis 12 need not be implemented as a cone. To that end, the chassis 12 may have any shape as desired for a particular application. Given by way of non-limiting examples, in various other embodiments the chassis 12 may include a cylinder, portion of a sphere, pyramid, or any other tapering shape as desired for a particular application.

In various embodiments, the chassis 12 may be made of any suitable material as desired. For example, given by way of illustration and not of limitation, the chassis 12 may be made of rubber, plastic, metal, and the like. It will be appreciated that making the chassis 12 from materials such as rubber, plastic, and metal can help increase durability and can help protect the athletic training device 10 from wear and tear.

In various embodiments and as mentioned above, the portion 14 is configured to receive the ball 16 thereon. That is, the portion 14 is shaped to function as a receptacle for the ball 16. It will be appreciated that the portion 14 may be shaped as desired to receive and hold (even if momentarily) the ball 16 thereon when an athlete places the ball 16 on the chassis 12 as part of an athletic training drill. It will be further appreciated that the portion 14 is also shaped to permit an athlete to access, grab, and remove the ball 16 readily from the chassis 12 as part of an athletic training drill.

It will be appreciated that the ball 16 may be any type of athletic ball or similar athletic device whatsoever that may be used as desired for any type of athletic training drill. Given by way of illustration only and not of limitation, the ball 16 may be a basketball, baseball, softball, football, soccer ball, tennis ball, heavy ball, golf ball, volleyball, nerf ball, bowling ball, lacrosse ball, hand ball, cricket ball, ping pong ball, racquetball, kickball, croquet ball, hockey puck, heavy ball softball, heavy ball baseball, heavy ball basketball, medicine ball, dog fetching ball, stress ball, safe t-ball, wiffle ball, hexagon hockey ball, tetherball ball, exercise ball, squash ball, bocce ball, pétanque ball, stability ball, futsal ball, rugby ball, pickleball ball, wall ball, water polo ball, hacky sack, or the like. It will be appreciated that the examples listed above for the ball 16 are non-limiting examples that are given by way of illustration only and not of limitation. It will be further appreciated that no limitation to the examples listed above for the ball 16 are intended and no such limitation is to be inferred.

It will be appreciated that, in various embodiments, the chassis 12 and the portion 14 are shaped and configured for use with a particular type of ball 16 and type of athletic drill. Given by way of non-limiting example, the chassis 12 may have a low profile for use in athletic drills that encourage the athlete to stay low (such as repeated placement of a tennis ball or the like on the portion 14). In another non-limiting example, the chassis 12 may have a high profile and may have a ruggedized construction for use in weight training or cross training drills that include repeated placement of a heavy object, such as a medicine ball or the like, on the portion 14 by an athlete in a standing or crouching position.

In some embodiments, if desired the bottom surface 22 may have an aggressive tread 24 (FIGS. 1A and 1C). It will be appreciated that, in such embodiments, the trad 24 may help provide traction on a variety of surfaces.

In various embodiments, the sensor 18 may be any suitable sensor that can sense presence of the ball 16 on the chassis 12. Given by way of non-limiting example, in various embodiments the sensor 18 can include a proximity sensor, a contact sensor, a motion sensor, a near-field communication tag, and the like. Given by way of illustration only and not of limitation, in some such embodiments in which the sensor 18 is implemented as a proximity sensor, the sensor 18 is suitably incorporated into the chassis within a few millimeters from the ball 16 when the ball 16 is seated in the portion 14. Given by way of non-limiting example, the sensor 16 may include a 5 mm reflective object sensor (such as model no. QRE1113GR) manufactured by Fairchild Semiconductor Corporation.

In some embodiments, if desired the sensor 18 may "wake up" the device 10. Given by way of non-limiting example, the device 10 may be operating in a low power mode that powers the sensor 18. When the sensor 18 senses that the ball 16 has been put in place, the device 10 may engage the display device 20 and other features as the device 10 "wakes up."

Figure 2:
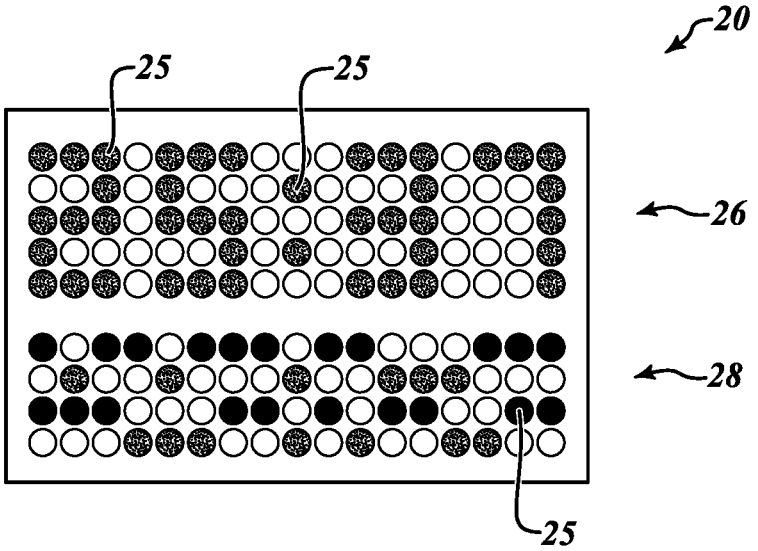
FIG. 2 is a schematic representation of an illustrative display device.

Referring additionally to FIG. 2, in various embodiments the display device 20 is disposed on the chassis 12. The display device 20 may include light-emitting diodes 25. The light-emitting diodes 25 may be configured to display indicia regarding timing and status. In some such embodiments, the light-emitting diodes 25 may be arranged in a matrix that permits the light-emitting diodes 25 to convey alpha-numeric information and graphical information. For example, the light-emitting diodes 25 may be arranged in a matrix in a display area 26 that permits the light-emitting diodes 25 to convey alpha-numeric information. It will be appreciated that such alpha-numeric information may include, without limitation, numbers, letters, charts, graphs, and other graphics. As another example, the light-emitting diodes 25 may be arranged in a matrix in a display area 28 that permits the light-emitting diodes 25 to convey graphical information. It will be appreciated that such graphical information may include, without limitation numbers, letters, charts, graphs, and other graphics.

In various embodiments, at least one of the light-emitting diodes 25 is dimmable. In some such embodiments, the light-emitting diodes 25 may be individually dimmable. In some other such embodiments, all of the light-emitting diodes 25 may be dimmed together as a whole.

Figure 3:
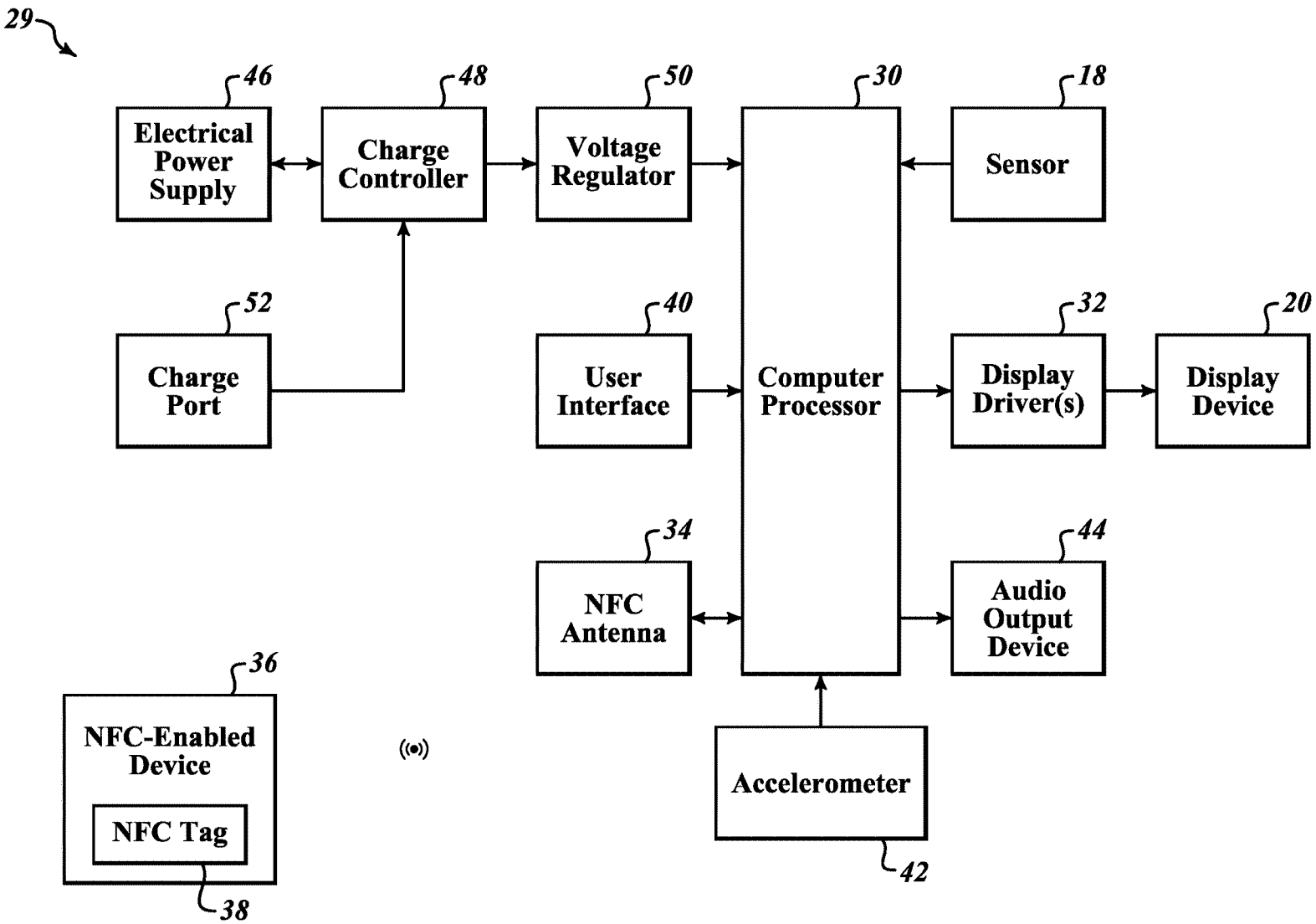
FIG. 3 is a block diagram of electronic circuitry of the athletic training device of FIG. 1A.

Referring additionally to FIG. 3, in various embodiments the device 10 includes electronic circuitry 29. In various embodiments, the electronic circuitry 29 includes a computer processor 30. The computer processor 30 suitably is configured to receive input from the sensor 18 and other input sources (discussed below), process the input, control operation of the device 10, provide various modes of operation for the athletic training device 10 (such as offline mode, quick start mode, and connected mode) and provide output for the display device 20 and other output devices (discussed below).

In various embodiments and given by way of non-limiting example, the computer processor 30 may be any suitable computer processor, such as a 32 bit processor, microprocessor, controller, microcontroller, central processing unit, or the like. In some embodiments, if desired the computer processor 30 may include an integrated Bluetooth Low Energy ("BLE") radio (including a BLE antenna). Given by way of non-limiting example, in various embodiments the computer processor 30 may include a 32 bit System-On-Chip ("SoC") microcontroller with an integrated BLE radio (such as, for example, a Nordic 32 Bit SoC microcontroller part number nRF52832 with an integrated Rigado BMD-350 BLE Bluetooth radio module). It will be appreciated that the BLE radio may communicate wirelessly with a tablet or a smart phone (such as may be used by an athlete or a coach as described below).

In various embodiments, the computer processor 30 is electrically coupled to receive input from the sensor 18. As discussed above, in various embodiments the sensor 18 is suitably incorporated into the chassis within a few millimeters from the ball 16 when the ball 16 is seated in the portion 14. As a result, it will be appreciated that, depending on geometry and available mounting space in the cassis 12, in various embodiments the sensor 18 may be disposed in the chassis separate from a printed circuit board that includes the computer processor 30. However, in some embodiments the sensor 18 may be disposed on the printed circuit board that includes the computer processor 30 when geometry and available mounting space in the cassis 12 permits such mounting of the sensor 18 and also permits the sensor 18 to be within a few millimeters from the ball 16 when the ball 16 is seated in the portion 14.

As discussed above, in various embodiments the display device 20 is responsive to the sensor 18. As also discussed above, the computer processor 30 is electrically coupled to receive input from the sensor 18. In various embodiments, the computer processor 30 is electrically coupled to provide output to one or more display drivers 32. The display driver(s) 32 is/are, in turn, electrically coupled to drive the display device 20 and to regulate electrical power to the display device 20. It will be appreciated that the display driver(s) 32 may be any suitable display driver as desired for a particular application.

In some embodiments that include a Bluetooth radio module, the Bluetooth radio module may function as a near-field communication radio-frequency transceiver. In such embodiments, if desired a near-field communication antenna 34 may be electrically couplable with the near-field communication radio-frequency transceiver.

In such embodiments, a near-field communication-enabled device 36 may include a near-field communication tag 38. The near-field communication tag 38 is couplable in wireless communication with the near-field communication antenna 34. In some such embodiments, the near-field communication-enabled device 36 may include a near-field communication-enabled ball. That is, in such embodiments the ball 16 is near-field communication-enabled. In such embodiments, any number of near-field communication-enabled balls 16 as desired can be used with one or more athletic training devices 10 for advanced drills and for various sports. For example, in such cases near-field communication-enabled balls 16 can be differentiated from each other. As another example, multiple devices may be connected and/or synchronized by tapping, thereby enabling switching users in a group setting. In other embodiments, the near-field communication-enabled device 36 may include a basketball net, a baseball pitchng net, a soccer net, or a hockey net. In such embodiments, these near-field communication-enabled devices 36 can wirelessly communicate with the athletic training device 10 to help enable various drills across various sports.

In various embodiments, the athletic device 10 includes a control interface 40. The control interface 40 is electrically coupled to the computer processor 30. In various embodiments, the control interface 40 may include a push button that is mounted on the chassis 12 at a location as desired to permit ready access by a user. In some such embodiments, the push button may include a tactile push button that is configured to provide a user with tactile feedback regarding actuation of the push button. In some embodiments, the control interface 40 is configured to turn the athletic training device 10 on and off. In some embodiments, the control interface 40 may be further configured to permit a user to select one of the modes of operation (including Bluetooth pairing, if desired) of the athletic training device 10. In some embodiments, additional controls may be provided via an application ("app") on a tablet or a smartphone.

In some embodiments, if desired an accelerometer 42 may be configured to sense motion and/or orientation of the device 10. In such embodiments, the accelerometer 42 is electrically coupled to provide input to the computer processor 30. The accelerometer 42 may be any type of accelerometer as desired, such as without limitation a three (3) axis accelerometer. When provided, the accelerometer 42 may be disposed in the chassis 12 as desired for a particular application. It will be appreciated that, when provided, the accelerometer 42 can help detect if the chassis 12 has been disturbed, remains upright, or the like.

In some embodiments, if desired the athletic training device 10 may include an audio output device 44. In such embodiments, the audio output device 44 is electrically coupled to receive output from the computer processor 30. In various embodiments, the audio output device 44 may include a beeper, a loudspeaker, a piezo-electric element, a buzzer, or the like. Given by way of non-limiting example, in some such embodiments the audio output device 44 may include a beeper with an output frequency range between around 2 KHz-4 KHz or with a discrete frequency output in a range between around 2 KHz-4 KHz.

In various embodiments, electrical power is supplied to the athletic training device 10 from an electrical power supply 46. In various embodiments, the electrical power supply 46 suitably provides direct current (DC) electrical power to the athletic training device 10 at voltage and current levels that are appropriate for the athletic training device 10. Given by way of non-limiting example, in some embodiments the electrical power supply 46 may include an alternating current (AC) to DC converter. Given by way of another non-limiting example, in some other embodiments the electrical power supply 46 may include a battery 46. In some such embodiments, the battery 46 may be a rechargeable battery such as, for example and without limitation, a lithium-ion (Li-ion) battery. Given by way of non-limiting example, in some such embodiments the battery 46 may power the athletic training device for a period of time of up to around eight (8) hours or so on a single charge. However, it will be appreciated that the battery 46 may be selected to power the athletic training device for any period of time as desired for a particular application. In embodiments in which the electrical power supply 46 includes a rechargeable battery, the battery may be charged via a connector such as without limitation a USB Micro-B type connector.

In embodiments in which the electrical power supply 46 includes a battery, output from the electrical power supply 46 may be electrically coupled to a charge controller 48. In such embodiments, the charge controller 48 is configured to help contribute to limiting the rate at which electric current is added to or drawn from the battery 46. To that end, in such embodiments the charge controller 48 helps prevent overcharging the battery 46 and may protect against overvoltage. It will be appreciated that overvolatage of the battery 46 can reduce performance and/or lifespan of the battery 46 and/or may, in some cases, pose a safety risk. It will also be be appreciated that, in such embodiments, the charge controller 48 may help contribute to draining (or deep discharging) the battery 46 or performing controlled discharges, depending on battery technology, thereby helping contribute to protecting life of the battery 46.

In some embodiments in which the charge controller 48 is provided, output from the charge controller 48 may be electrically coupled to a voltage regulator 50. In such embodiments, output from the voltage regulator 50 is electrically coupled to the computer processor 30. In such embodiments, the voltage regulator 50 is configured to automatically maintain a substantially constant voltage level.

In some embodiments in which the charge controller 48 is provided, a charge port 52 may be provided in the chassis 12 and electrically coupled to the charge controller 48. The charge port 52 is configured to be electrically couplable to a source of electrical power that can charge and/or re-charge the battery 46. In some such embodiments, the charge port 52 may include an electrical connector such as a USB connector (like a USB Micro-B type connector) or the like.

Figure 4:
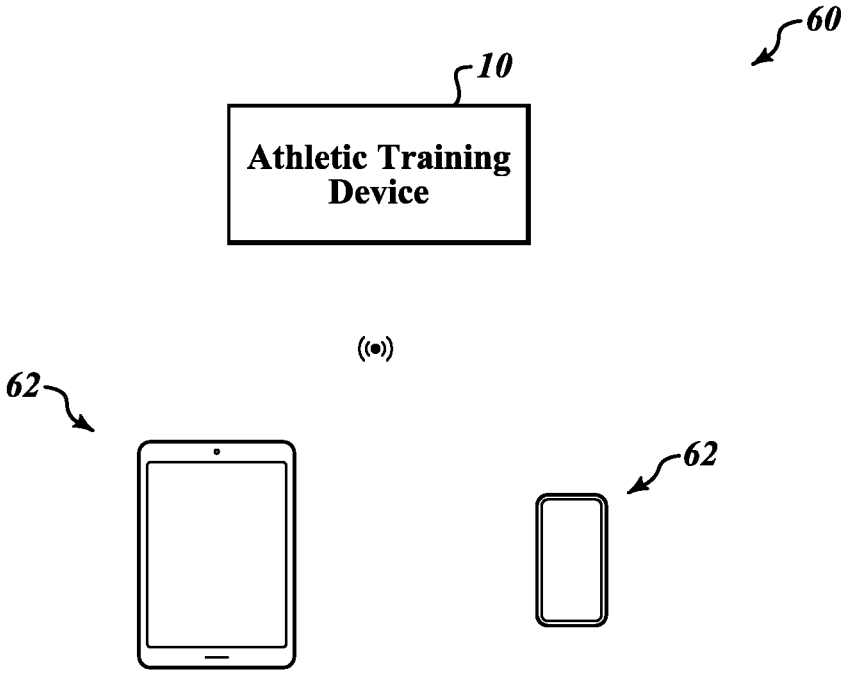
FIG. 4 is a block diagram of an illustrative athletic training system.

Referring additionally to FIG. 4, in various embodiments an athletic training system 60 includes the athletic training device 10 and at least one user interface device 62. It will be appreciated that the athletic training device 10 has been described above and that details of its construction and operation need not be repeated for an understanding of disclosed subject matter.

In various embodiments, the user interface device 62 and the athletic training device 10 are configured for wireless communication with each other. As discussed above, in various embodiments the athletic training device 10 includes a Bluetooth radio module. In such embodiments, the user interface device 62 may include a wireless device such as a smart phone and/or a tablet. As is known, wireless devices (such as a smart phone and/or a tablet) are configured for wireless communication, such as via Bluetooth RF radio communication and the like.

As is also known, wireless devices or mobile devices (such as a smart phone and/or a tablet) like the user interface device 62 include computer processors that are configured to execute applications (known as "apps"). Those skilled in the art will recognize that at least a portion of the user interface devices 62 and/or processes described herein can be integrated into a data processing system. Those having skill in the art will recognize that a data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control effectors (such as, for example, feedback for sensing position and/or velocity; control motors for moving and/or adjusting components and/or quantities; and the like). A data processing system may be implemented utilizing suitable commercially available components, such as those typically found in data computing/communication and/or network computing/communication systems. Because such devices are extremely well known, further description is not necessary for an understanding by those skilled in the art.

Referring additionally to FIGS. 5A-5K, in various embodiments the user interface device 62 may be accessible by an athlete. In such embodiments, an illustrative athletic training app may be loaded and executed on the user interface device 62 for use by an athlete. It will be appreciated that, in such embodiments, the system 60 can help enable provision of personalized training to an athlete via the athletic training device 10 and a wirelessly-connected user interface device 62 that includes the athletic training app. For example, in some such embodiments the athletic training app can help guide an athlete through workouts based on factors such as, without limitation, the athlete's experience level, the athlete's training goals, or a coach's assignments. As another example, in some such embodiments the athletic training device 10 can help time, count, and/or track an athlete's individual workouts and log them into the athletic training app. As another example, the athletic training app can help report progress, help add an athlete to leaderboards for workouts, and can help challenge an athlete's teammates and others.

Figure 5A:
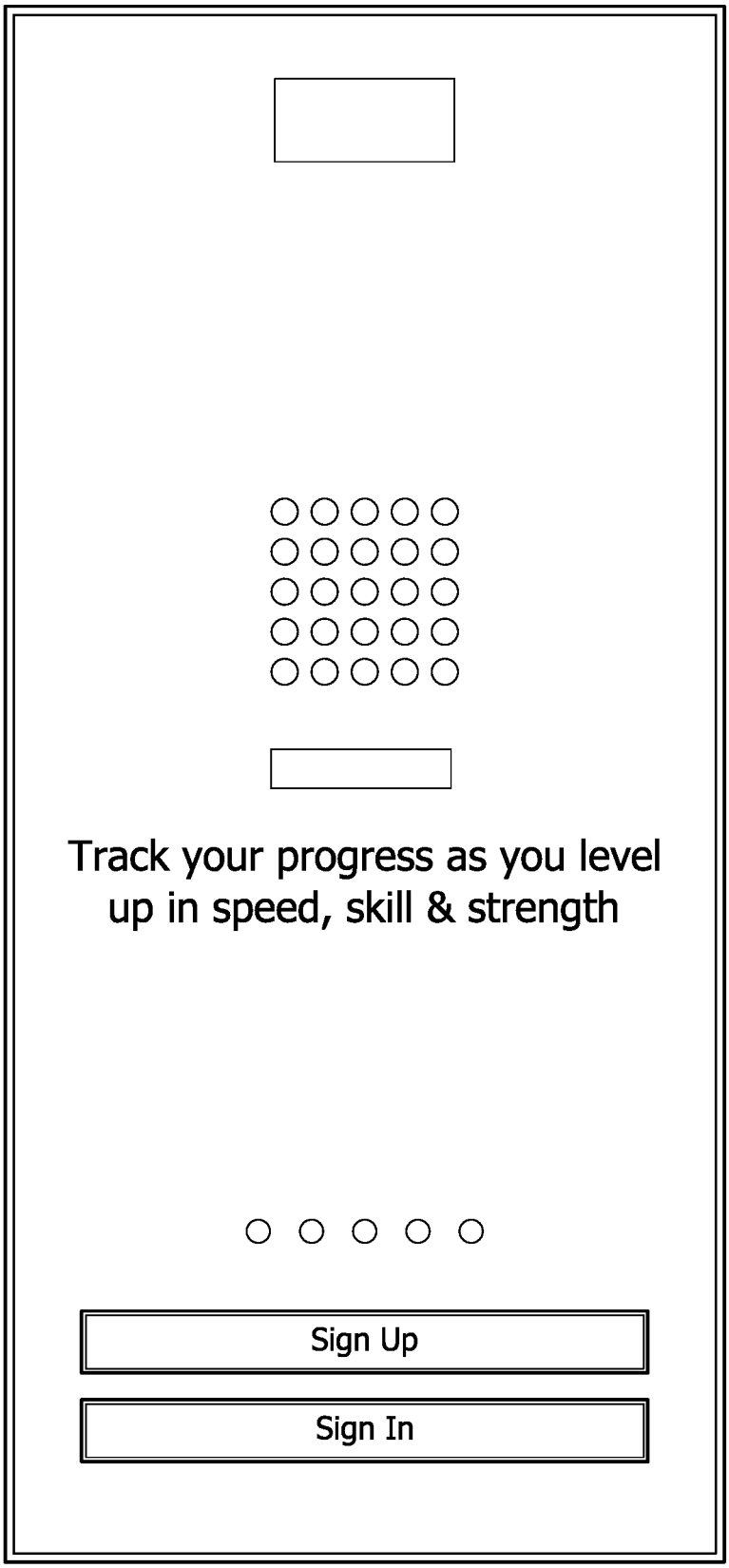
FIGS. 5A-5K are screen shots from an illustrative athletic training app.
Figure 5B:
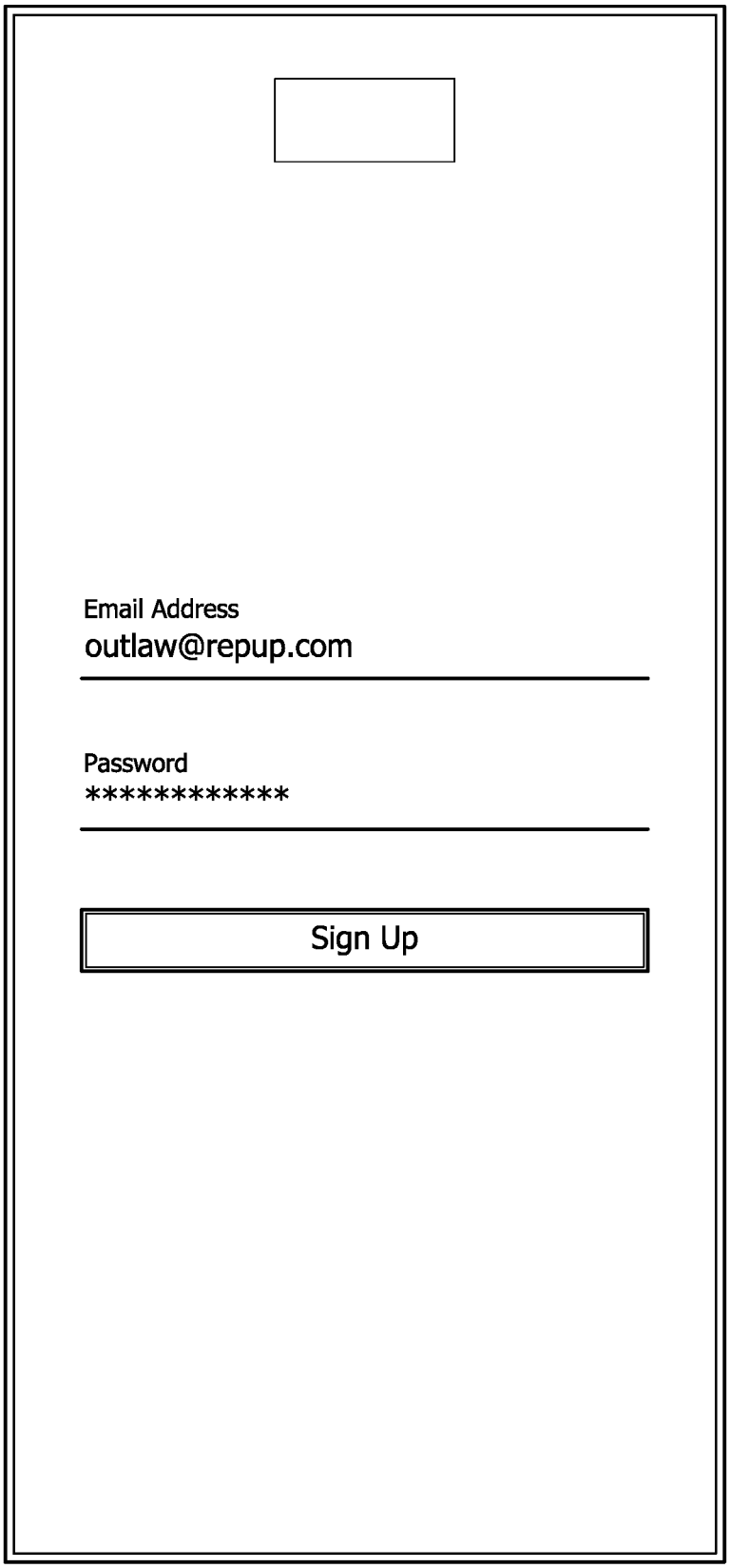
Figure 5C:
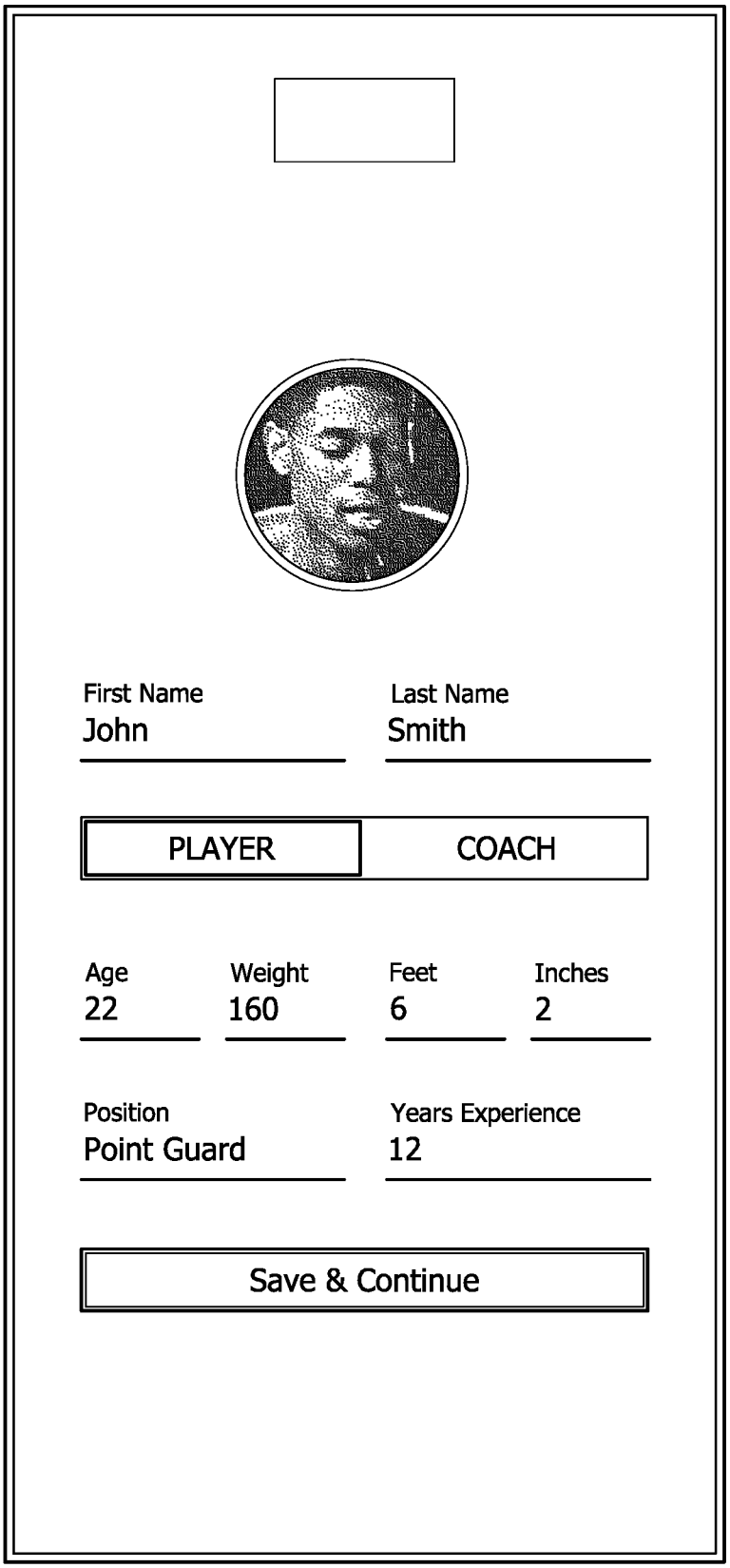
Figure 5D:
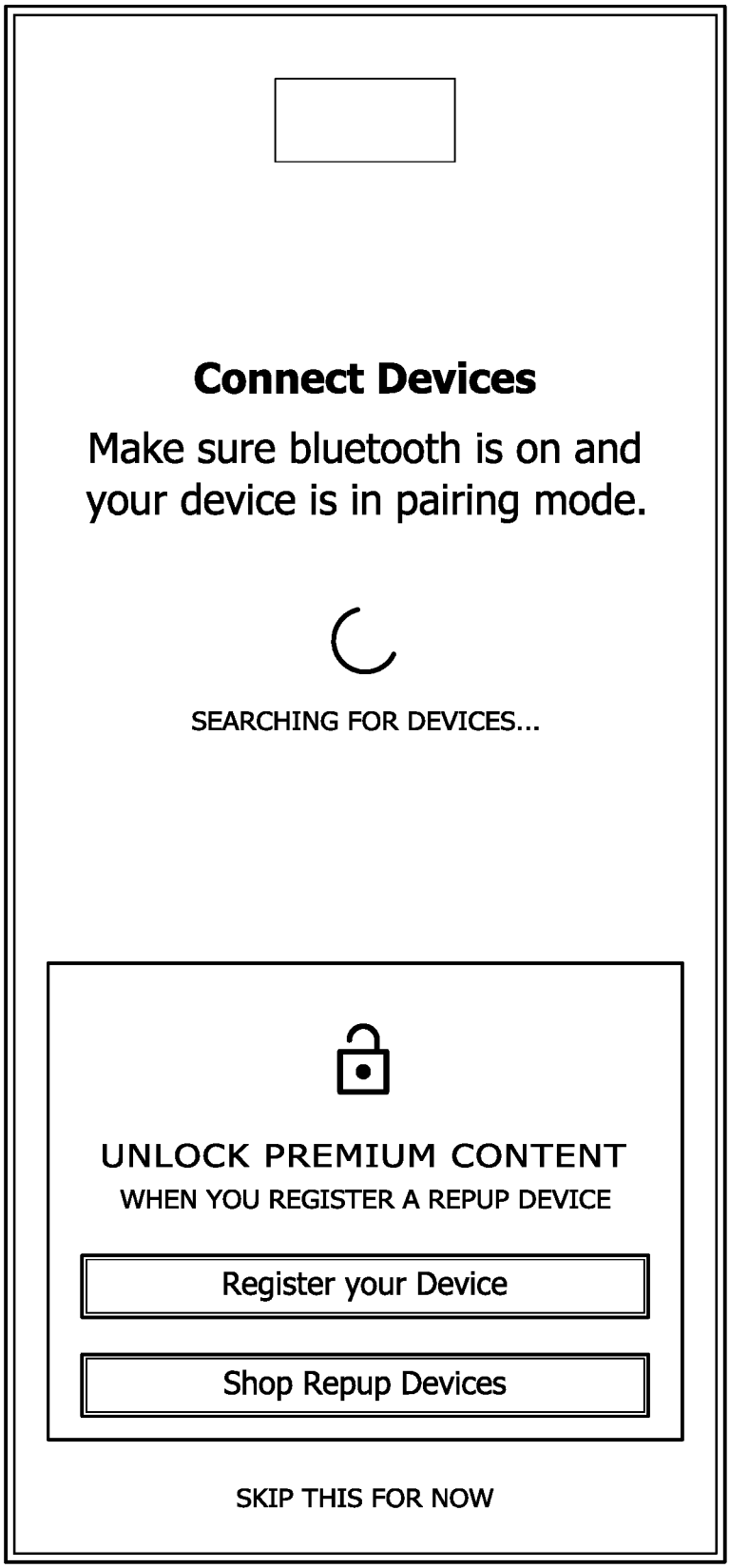
Figure 5E:
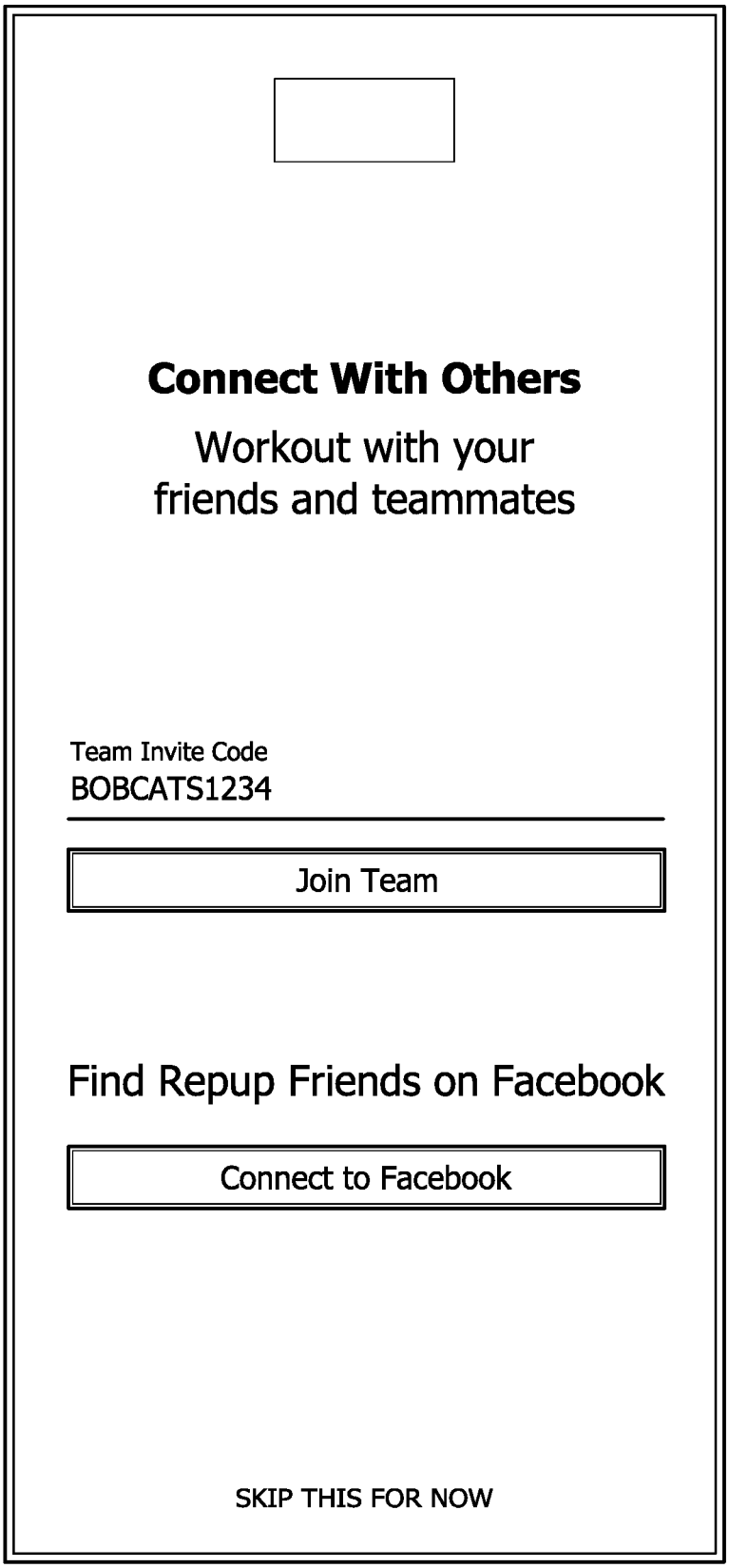

Following are a series of screen shots from an illustrative athletic training app that provide examples by way of illustration only and not of limitation. In various embodiments, the app presents several screens for housekeeping and handshaking functions. For example and as shown in FIG. 5A, at a screen 110 a user can select signing up for the app or signing in to the app. As shown in FIG. 5B, at a screen 112 a user can supply information, such as without limitation a user name (like an Email address or the like) and a password, to establish an account or to sign in to an existing account. As shown in FIG. 5C, at a screen 114 a user can enter personal information, such as name, athlete or coach, age, weight, height, position, and years of experience. As shown in FIG. 5D, at a screen 116 a user can pair the user interface device 62 and the athletic training device 10 (and, if desired, other user interface devices). As shown in FIG. 5E, at a screen 118 an athlete can enter a team invitation code and join a team of other athletes or can find other athletes with whom to engage, such as via social media platforms. While the screen 118 is applicable to athletes (and not coaches), it will be appreciated that screens 110, 112, 114, and 116 are applicable to athletes and coaches.

Figure 5F:
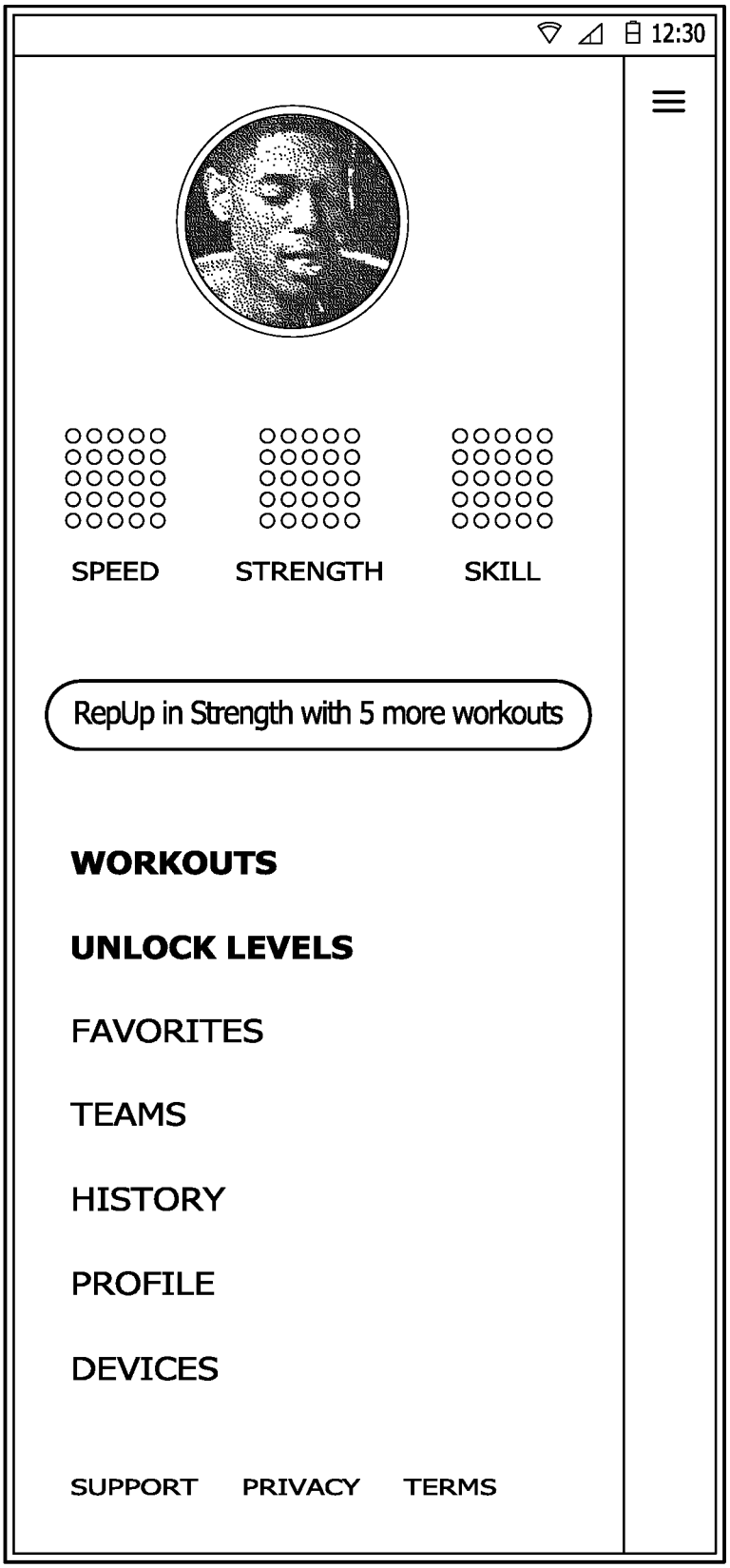

In various embodiments, the athletic training app presents several screens to an athlete for use in connection with athletic training drills. For example and as shown in FIG. 5F, at a screen 120 an athlete can select among several categories for continued use, such as workouts, levels of difficulty of training drills, favorite workouts, teams of athletes, workput history, the athlete's profile, and devices.

Figure 5G:
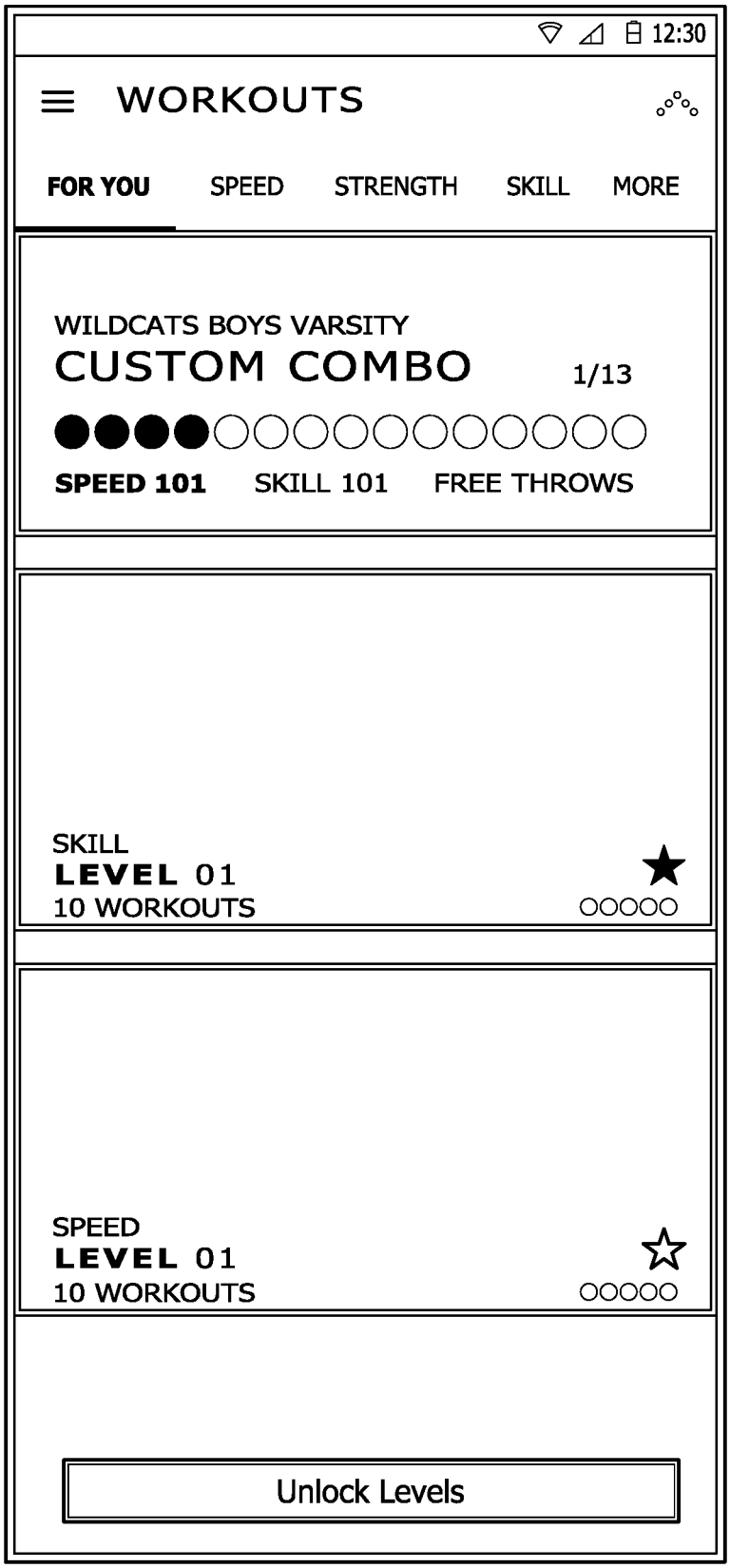
Figure 5H:
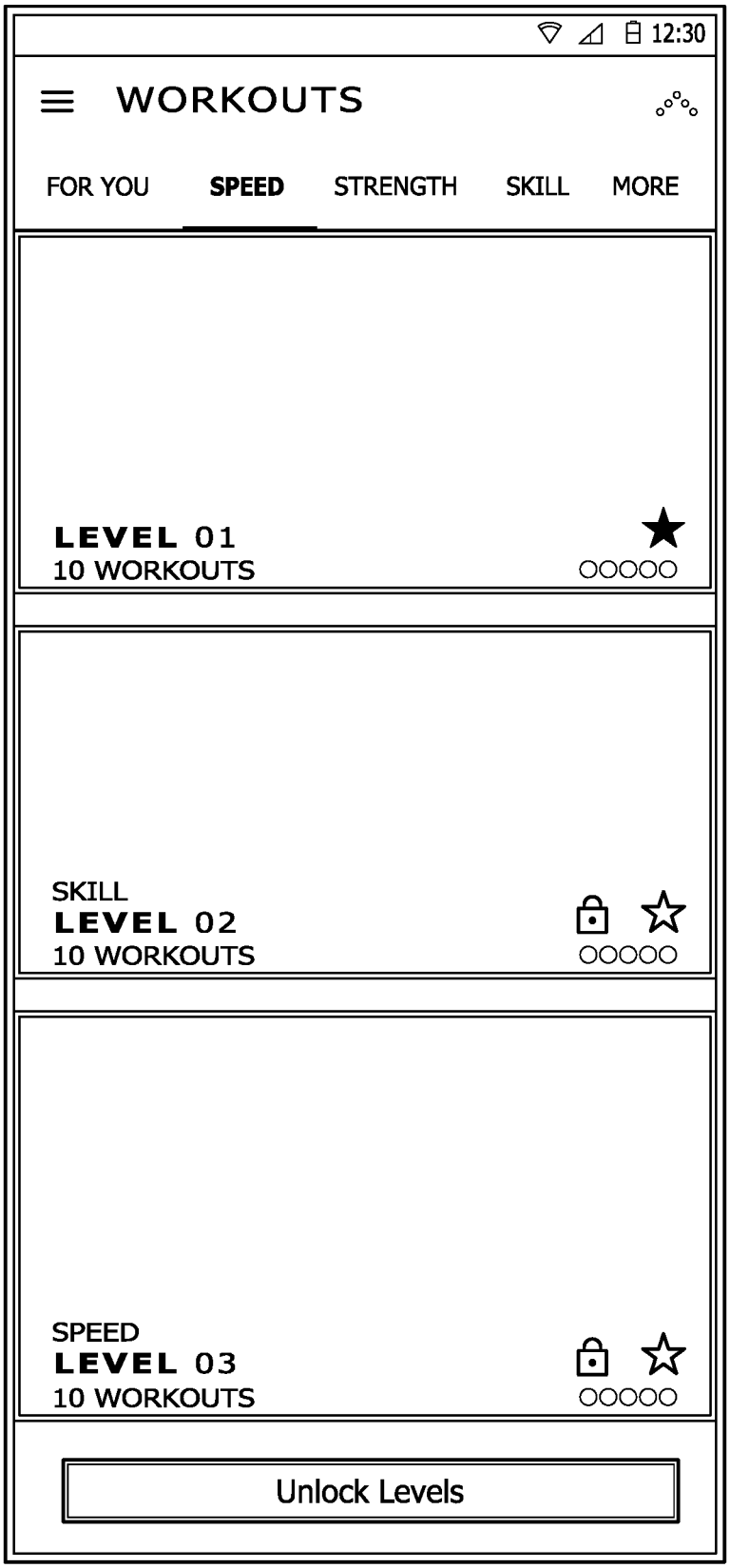
Figure 5I:
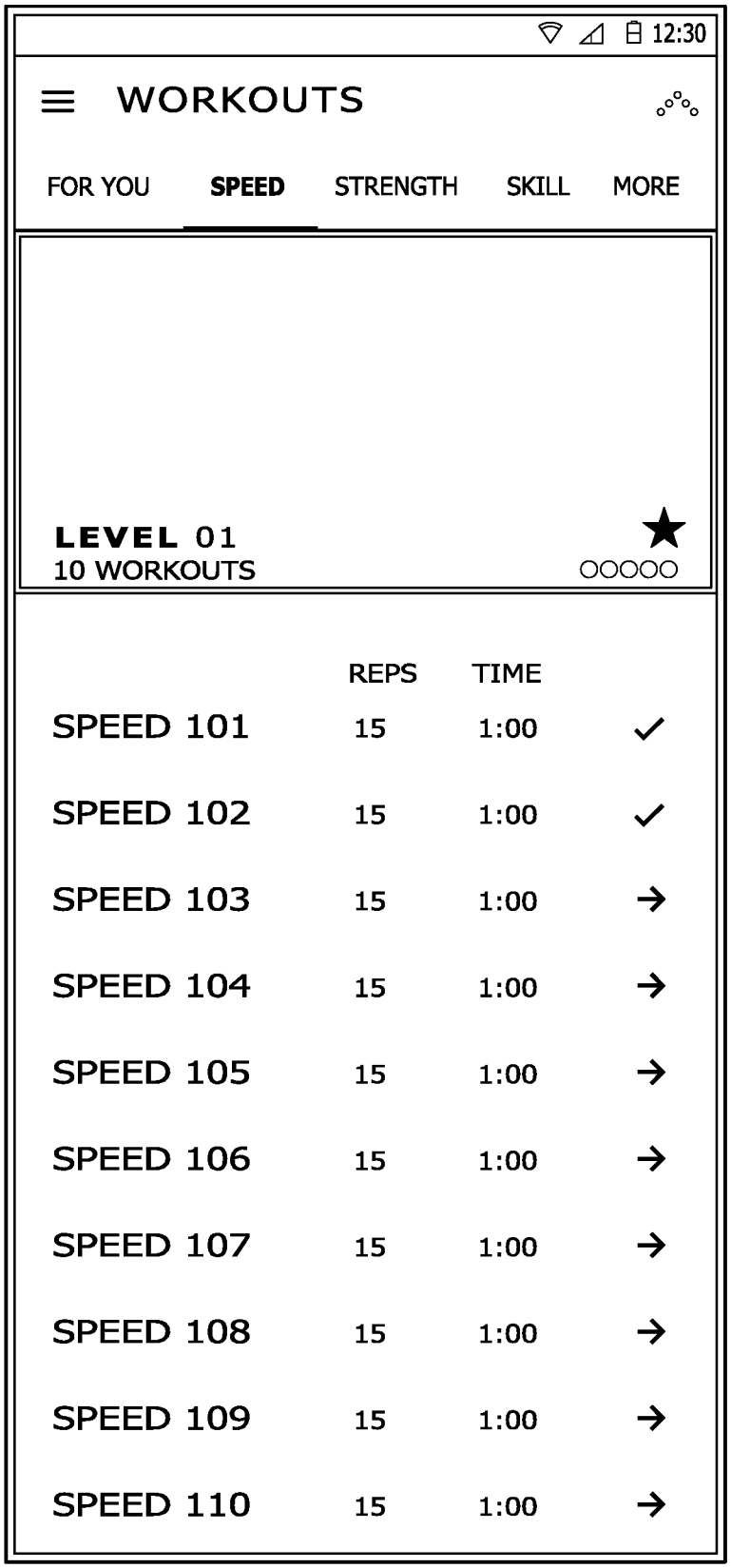
Figure 5J:
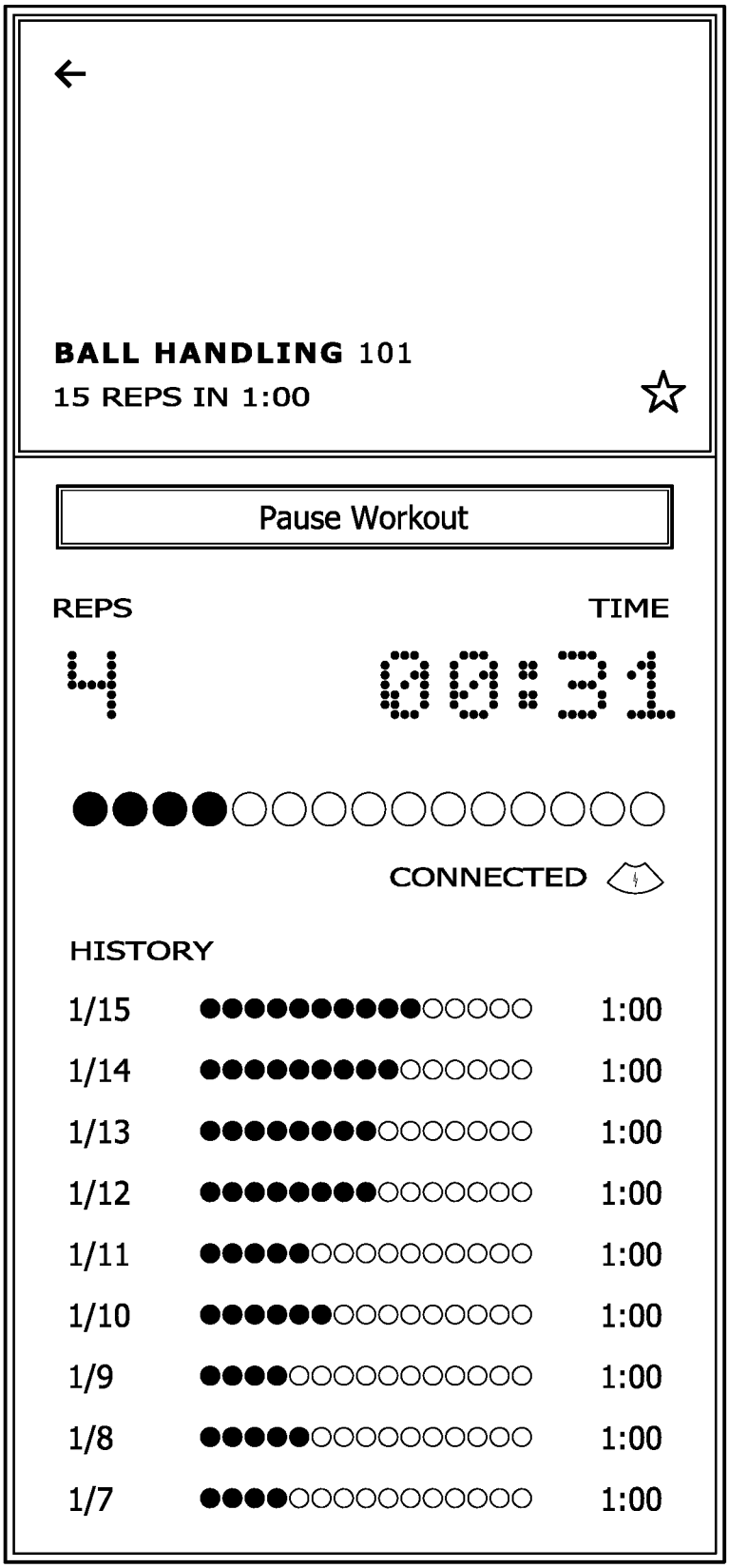
Figure 5K:
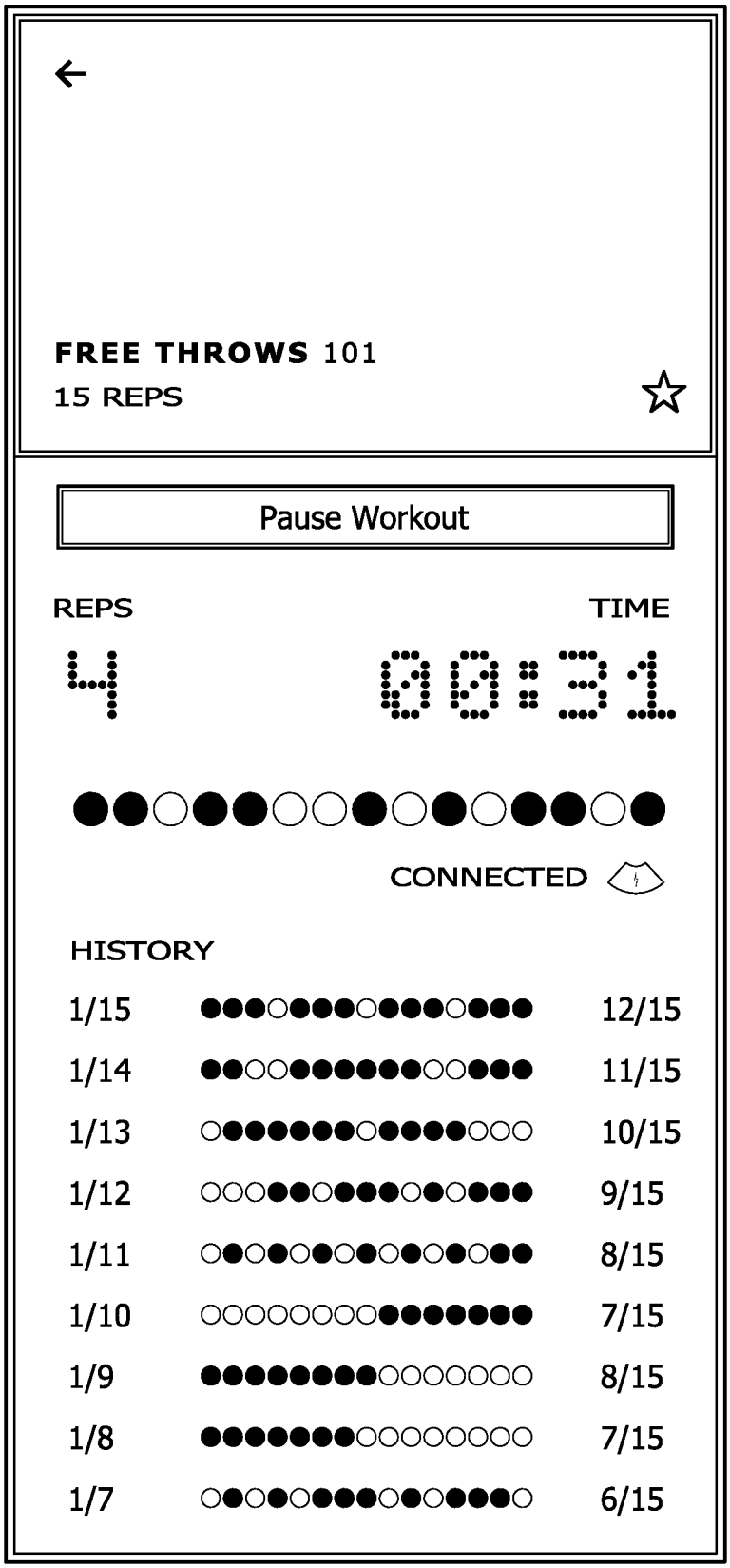

In various embodiments, upon selecting "workouts" an athlete can next select among different categories of workouts, such as custom workouts, speed workouts, strength workouts, skill workouts, and the like. For example, upon selecting custom workouts and as shown in FIG. 5G, at a screen 122 an athlete can select from workouts that have been personalized for the athlete or for a team of athletes of which the athlete is a member. That is, in various embodiments an athlete can be presented with recommended workouts based upon the athlete's history. In such embodiments, the athlete can pick up a workout where the athlete left off, can advance to a next level of workouts or assignments from a coach, or the like. Upon selecting speed workouts and as shown in FIG. 5H, at a screen 124 an athlete can select a desired level of speed workouts. Upon selecting a desired level of speed workouts and as shown in FIG. 5I, at a screen 126 an athlete can select a desired speed workout from several speed workouts that are available within the selected workout level. The athlete can also see which workouts have been completed. As another example and as shown in FIGS. 5J and 5K, upon selecting skill workouts an athlete can perform workouts that emphasize desired skills. For example and given by way of illustration and not of limitation, at a screen 128 (FIG. 5J) an athlete can perform a ball handling drill and a screen 130 (FIG. 5K) an athlete can perform a free throw drill. As shown in FIGS. 5J and 5K, an athlete can track performance of the workout. Given by way of non-limiting example and as shown in FIG. 5K, in some embodiments an athlete can tap on different sides of a representation of the athletic training device 10 for free throws made by the athlete and/or free throws missed by the athlete.

Referring additionally to FIGS. 6A-6D, in various embodiments the user interface device 62 may be accessible by a coach. In such embodiments, an illustrative coaching app may be loaded and executed on the user interface device 62 for use by a coach. It will be appreciated that, in such embodiments, the system 60 can help enable a coach to manage multiple teams, create custom routines and custom drills, create team assignments and individual assignments, and track progress.

Figure 6A:
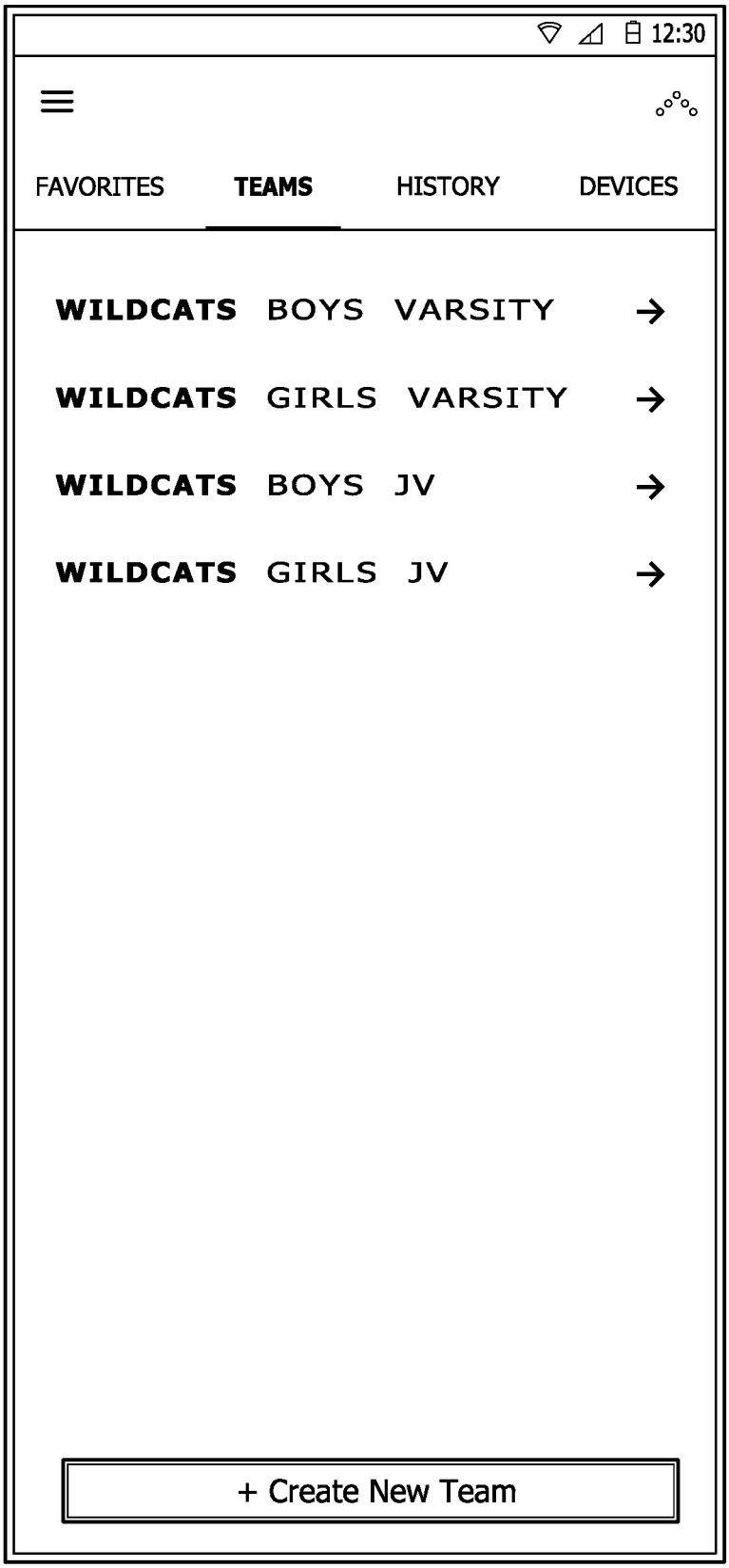
FIGS. 6A-6D are screen shots from an illustrative coaching app.
Figure 6B:
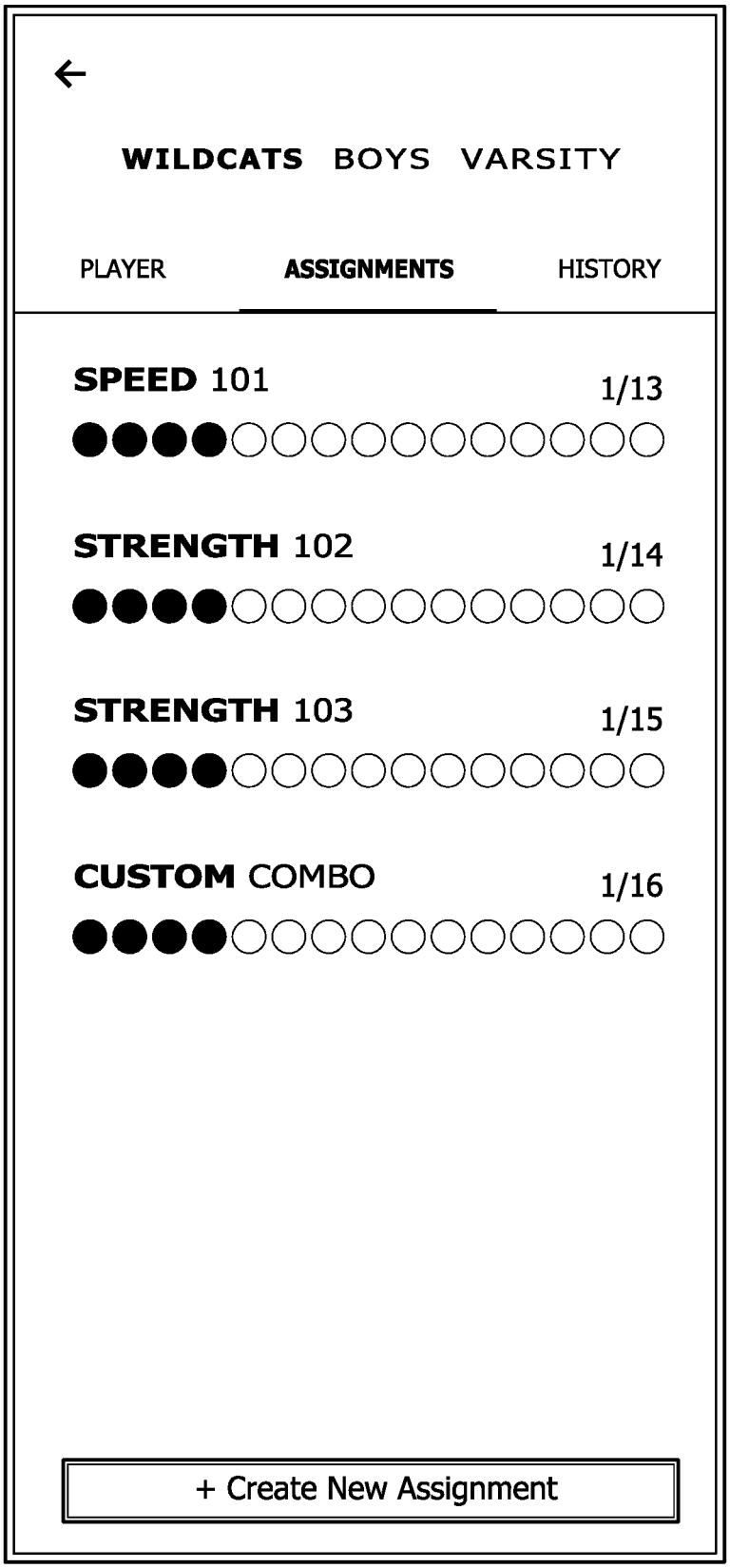
Figure 6C:
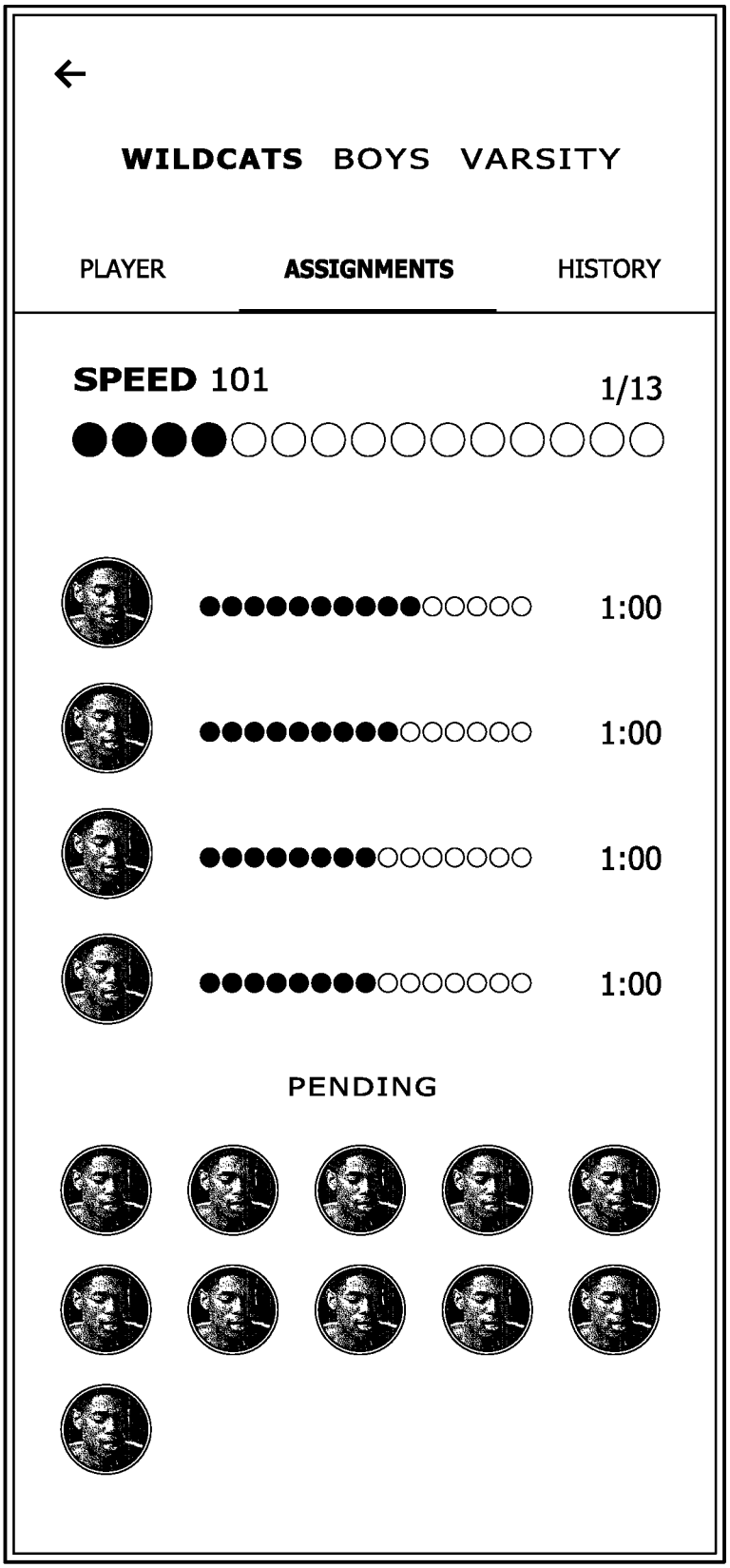
Figure 6D:
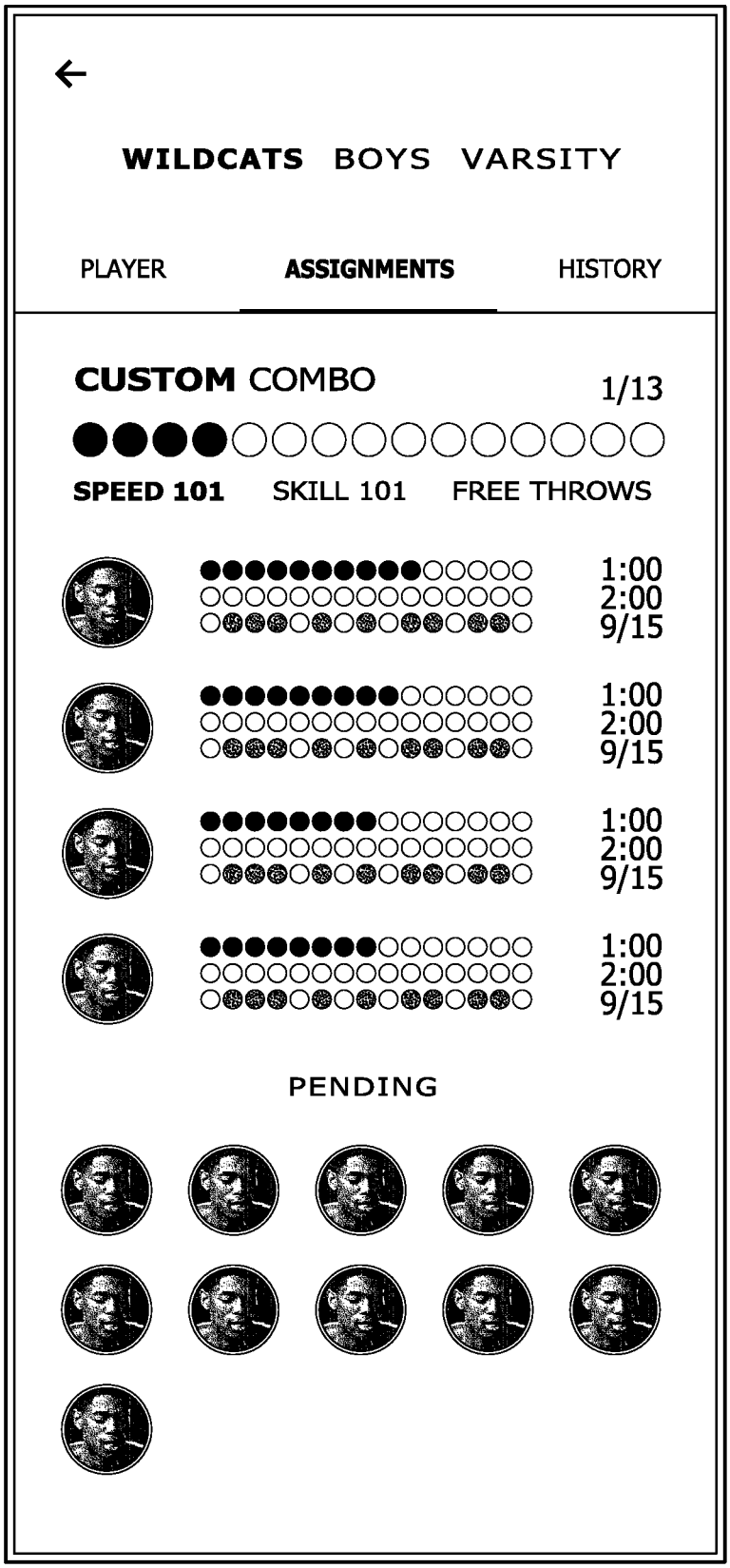

In various embodiments, the coaching app presents several screens to a coach for use in connection with coaching athletes and/or teams of athletes. For example and as shown in FIG. 6A, at a screen 140 a coach can select among several athletes and/or teams of athletes to manage. As shown in FIG. 6B, at a screen 142 a coach can create assignments for athletes and/or teams of athletes and can monitor progress. As shown in FIG. 6C, at a screen 144 a coach can monitor indicia of progress, such as without limitation which team and/or athlete has completed an assignment. Also at the screen 144, in various embodiments a coach can monitor statistics. As shown in FIG. 6D, at a screen 146 a coach can view all results for multiple drills in one assignment screen.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While a number of illustrative embodiments and aspects have been illustrated and discussed above, those of skill in the art will recognize certain modifications, permutations, additions, and sub-combinations thereof. It is therefore intended that the following appended claims and claims hereafter introduced are interpreted to include all such modifications, permutations, additions, and sub-combinations as are within their true spirit and scope.

What is claimed is:

1. An athletic training device comprising:

a chassis including one of a cone, a cylinder, a portion of a sphere, a pyramid, and a tapering structure, an uppermost portion of the chassis defining a receptacle to receive and hold a ball thereon on top of the chassis;

a sensor disposed in the chassis and configured to sense presence of a ball on the portion of the chassis and generate a signal indicative of sensed presence of a ball on the portion of the chassis; and a display device incorporated into a side of the chassis below the receptacle defined by the uppermost portion of the chassis and responsive to the sensor, wherein the display device is configured to display information relating to at least one of a time and a status relating to the signal generated by the sensor relating to the presence of the ball on top of the chassis and wherein the display is configured to present at least one of alpha-numeric information including at least one of a number and a letter and graphical information including at least one of a chart and graph.

2. The athletic training device of claim 1, wherein the sensor includes a proximity sensor.

3. The athletic training device of claim 1, wherein the display device includes a plurality of light-emitting diodes.

4. The athletic training device of claim 3, wherein at least one of the plurality of light-emitting diodes is dimmable.

5. The athletic training device of claim 1, further comprising a computer processor.

6. The athletic training device of claim 1, further comprising:

a near-field communication radio-frequency transceiver; and a near-field communication antenna electrically couplable with the near-field communication radio-frequency transceiver.

7. The athletic training device of claim 1, further comprising a control interface.

8. The athletic training device of claim 7, wherein the control interface is configured to turn the device on and off.

9. The athletic training device of claim 7, wherein the control interface is configured to permit a user to select one of a plurality of modes.

10. The athletic training device of claim 1, further comprising an accelerometer configured to sense at least one of motion and orientation.

11. The athletic training device of claim 1, further comprising an audio output device.

12. The athletic training device of claim 1, further comprising a near-field communication-enabled device.

13. The athletic training device of claim 12, wherein the near-field communication-enabled device includes a near-field communication-enabled ball.

14. The athletic training device of claim 12, wherein the near-field communication-enabled device includes a device chosen from a basketball net, a baseball pitching net, a soccer net, and a hockey net.

15. An athletic training device comprising:

a chassis including a cone, an uppermost portion of the cone defining a receptacle to receive and hold a ball thereon on top of the cone;

a sensor including a proximity sensor, the sensor disposed in the chassis and being configured to sense presence of a ball on the portion of the cone and generate a signal indicative of sensed presence of a ball on the portion of the chassis; and a display device incorporated into a side of the chassis below the receptacle defined by the uppermost portion of the chassis and including a plurality of light-emitting diodes, the display device being responsive to the sensor and configured to display information relating to at least one of a time and a status relating to the signal generated by the sensor relating to the presence of the ball on top of the chassis and wherein the display is configured to present at least one of alpha-numeric information including at least one of a number and a letter and graphical information including at least one of a chart and graph.

16. The athletic training device of claim 15, wherein at least one of the plurality of light-emitting diodes is dimmable.

17. The athletic training device of claim 15, further comprising a computer processor.

18. The athletic training device of claim 15, further comprising:

a near-field communication radio-frequency transceiver; and a near-field communication antenna electrically couplable with the near-field communication radio-frequency transceiver.

19. The athletic training device of claim 15, further comprising a control interface.

20. The athletic training device of claim 19, wherein the control interface is configured to turn the device on and off.

21. The athletic training device of claim 19, wherein the control interface is configured to permit a user to select one of a plurality of modes.

22. The athletic training device of claim 15, further comprising an accelerometer configured to sense at least one of motion and orientation.

23. The athletic training device of claim 15, further comprising an audio output device.

24. The athletic training device of claim 15, further comprising a near-field communication-enabled device.

25. The athletic training device of claim 24, wherein the near-field communication-enabled device includes a near-field communication-enabled ball.

26. The athletic training device of claim 24, wherein the near-field communication-enabled device includes a device chosen from a basketball net, a baseball pitching net, a soccer net, and a hockey net.

27. An athletic training system comprising:

an athletic training device including:

a chassis including one of a cone, a cylinder, a portion of a sphere, a pyramid, and a tapering structure, an uppermost portion of the chassis defining a receptacle having a size and shape to receive a ball thereon and to prevent passage of the ball therethrough into the chassis;

a sensor disposed in the chassis and configured to sense presence of a ball on the portion of the chassis and generate a signal indicative of sensed presence of a ball on the portion of the chassis, the chassis being configured to permit a ball to remain received on the portion of the chassis responsive to the signal indicative of sensed presence of a ball on the portion of the chassis; and a display device incorporated into a side of the chassis below the receptacle defined by the uppermost portion of the chassis and responsive to the sensor, wherein the display device is configured to display information relating to at least one of a time and a status relating to the signal generated by the sensor relating to the presence of the ball on top of the chassis and wherein the display is configured to present at least one of alpha-numeric information including at least one of a number and a letter and graphical information including at least one of a chart and graph; and at least one user interface device separate from the chassis and configured to receive and display information representative of the time and the status.

28. The athletic training system of claim 27, wherein the at least one user interface device and the athletic training device are configured for wireless communication with each other.

29. The athletic training system of claim 28, wherein the at least one user interface device includes a wireless device chosen from a smart phone and a tablet.

30. The athletic training system of claim 27, wherein the at least one user interface device includes a device accessible by an athlete.

31. The athletic training system of claim 27, wherein the at least one user interface device includes a device accessible by a coach.

32. The athletic training system of claim 27, wherein the sensor includes a proximity sensor.

33. The athletic training system of claim 27, wherein the display device includes a plurality of light-emitting diodes.

34. The athletic training system of claim 33, wherein the plurality of light-emitting diodes is configured to display indicia regarding timing and status.

35. The athletic training system of claim 33, wherein at least one of the plurality of light-emitting diodes is dimmable.

36. The athletic training system of claim 27, further comprising a computer processor.

37. The athletic training system of claim 27, further comprising:

a near-field communication radio-frequency transceiver; and a near-field communication antenna electrically couplable with the near-field communication radio-frequency transceiver.

38. The athletic training system of claim 27, further comprising a control interface.

39. The athletic training system of claim 38, wherein the control interface is configured to turn the device on and off.

40. The athletic training system of claim 38, wherein the control interface is configured to permit a user to select one of a plurality of modes.

41. The athletic training system of claim 27, further comprising an accelerometer configured to sense at least one of motion and orientation.

42. The athletic training system of claim 27, further comprising an audio output device.

43. The athletic training system of claim 27, further comprising a near-field communication-enabled device.

44. The athletic training system of claim 43, wherein the near-field communication-enabled device includes a near-field communication-enabled ball.

45. The athletic training system of claim 43, wherein the near-field communication-enabled device includes a device chosen from a basketball net, a baseball pitching net, a soccer net, and a hockey net.

* * * * *